United States Patent [19]

Smallegan

[11] 3,968,355

[45] July 6, 1976

[54] AUTOMATIC NIGHT LIGHT STRUCTURE

[75] Inventor: Jon Smallegan, Ann Arbor, Mich.

[73] Assignee: Novo Products, Inc., Farmington, Mich.

[22] Filed: Mar. 31, 1975

[21] Appl. No.: 563,595

[52] U.S. Cl. ..... 240/2 R; 200/61.02; 240/DIG. 6

[51] Int. Cl.[2] ..... F21V 33/00

[58] Field of Search ..... 240/2 R, 153, DIG. 6, 240/1 R, 52 R; 200/61.02; 315/158

[56] References Cited

UNITED STATES PATENTS

| | | | |
|---|---|---|---|
| 2,928,025 | 3/1960 | McIlvaine | 200/61.02 |
| 3,176,189 | 3/1965 | Tabet | 315/158 |
| 3,456,155 | 7/1969 | Buchanan | 315/158 |
| 3,751,711 | 8/1973 | Schick | 240/DIG. 6 |
| 3,757,102 | 9/1973 | Roberts | 240/2 R |
| 3,819,923 | 6/1974 | Schumacher | 240/1 R |

*Primary Examiner*—Stephen J. Tomsky
*Attorney, Agent, or Firm*—Harness, Dickey & Pierce

[57] ABSTRACT

An automatic night light which will change its illumination in response to changes in the ambient light level. The circuit comprises an AC input with the lamp and a solid-state switch connected in series, a resistive voltage divider being connected across the solid-state switch and having series-connected fixed and light-sensitive resistors. The switch gate is connected to the voltage divider tap by a bidirectional conductor. The structure comprises a housing having circuit and lamp portions. The circuit portion has outlet prongs with bent-back ends, a circuit board being supported by notches in the housing and the prong ends. The housing also supports spring contacts which connect the circuit board to the lamp socket in a simple manner, with the light-sensitive device being easily mountable and firmly supported by the housing.

10 Claims, 5 Drawing Figures

AUTOMATIC NIGHT LIGHT STRUCTURE

BACKGROUND OF THE INVENTION

1. Field of the Invention

The invention relates to night lights, and more particularly to automatic devices which may be used indoors to illuminate an area automatically only when the ambient light drops below a certain level.

2. Description of the Prior Art

Devices are known which can be used in outdoor lamp posts or other outdoor lights, and will turn on the lights in response to changes in ambient conditions. Such devices are placed between the light bulb and the socket. Devices are also known which are usable with indoor lamps and can be plugged into the wall to control operation of the lamp in response to ambient light level changes. However, as far as it is known, such prior devices are relatively complex in their construction and are expensive to build.

BRIEF SUMMARY OF THE INVENTION

It is an object of the present invention to provide a novel and improved automatic night light which is both inexpensive to construct and attractive in appearance.

It is a further object to provide an improved device of this nature in which the light-sensitive portion is made prominent so as to allow maximum entrance of light necessary for operation.

Briefly, the invention comprises a housing having a circuit portion and a lamp portion extending from one side thereof, a pair of household socket prongs extending from one end of said circuit portion, a light-sensitive element mounted on the end of said housing circuit portion opposite said prongs, a circuit board within said housing circuit portion, bent-back portions on said prong having ends extending into said housing circuit portion, said ends being slotted and receiving corners of said circuit board, and recesses in said housing circuit portion receiving the opposite ends of said circuit board.

The invention further comprises a wall between said lamp and circuit board portions of the housing, a pair of slots in said wall, a pair of spring contacts extending through said slots and engageable by a lamp mounted in said lamp portion of the housing, and means electrically connecting said spring contacts to the circuit board.

There is a fixed resistor in said housing circuit portion connected to the circuit board, connections from said light-sensitive device to said circuit board, solid-state switching means in said housing circuit portion and having at least an anode, a cathode and a gate, means on said circuit board connecting said fixed resistor and light-sensitive resistor in series, a voltage divider tap between said fixed resistor and light-sensitive device, and a bidirectional conductor connecting said tap to said gate.

DESCRIPTION OF THE PREFERRED EMBODIMENTS

Figure 1:
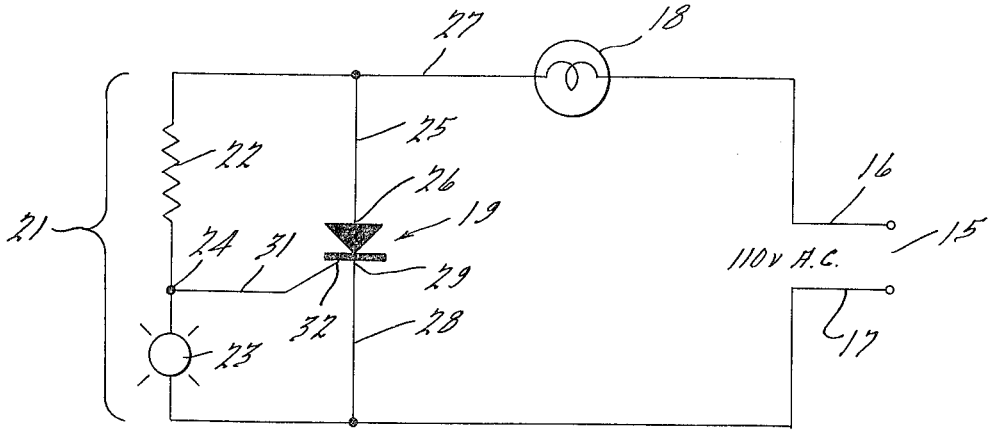
FIG. 1 is a circuit diagram of the automatic night light of this invention.
Figure 2:
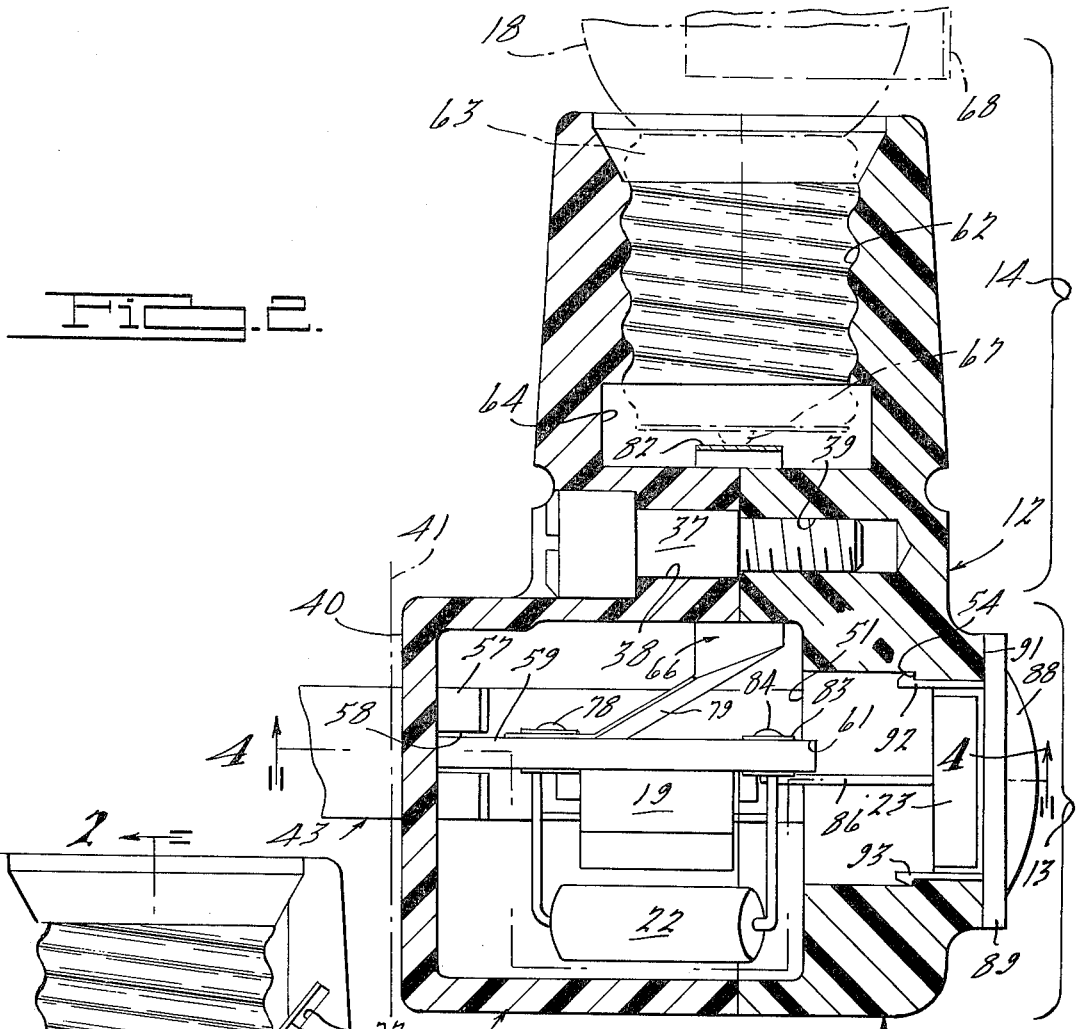
FIG. 2 is a cross-sectional view in elevation of the unit, taken along the line 2—2 of FIG. 3.

The night light is generally indicated at 11 and comprises a housing generally indicated at 12 in FIG. 2 having a circuit portion indicated by the bracket 13 and a lamp portion designated by bracket 14. The basic circuit elements of the night light are shown typically in FIG. 1. These include an alternating power source 15 having a first lead 16 and a second lead 17, a lamp 18 and a solid-state switch generally indicated at 19 such as a silicon controlled rectifier (SCR) connected in series between poles 16 and 17, a voltage divider indicated by the bracket 21 connected across switch 19, the voltage divider comprising a fixed resistor 22 in series with a light-sensitive resistive device 23 exposed to ambient light and having the voltage divider tap 24 therebetween, a first bidirectional conductor 25 between the anode 26 of switch 19 and the connection 27 between lamp 18 and resistor 22, a second bidirectional conductor 28 between cathode 29 of the switch and pole 17, and a third bidirectional conductor 31 between voltage divider tap 24 and gate 32.

In operation of the circuit of FIG. 1, voltage divider 21 will apply a voltage to gate 32 of SCR 19 which is inversely proportional to the ambient light level sensed by device 23. Lamp 18 acts as a load for the SCR and will be activated when the voltage drop across device 23 causes the potential at gate 32 to be higher than the potential at cathode 29. The circuit will have a tendency to modulate the light output of lamp 18 with the ambient light level, the lamp being brightest when the room light level is the darkest.

Figure 4:
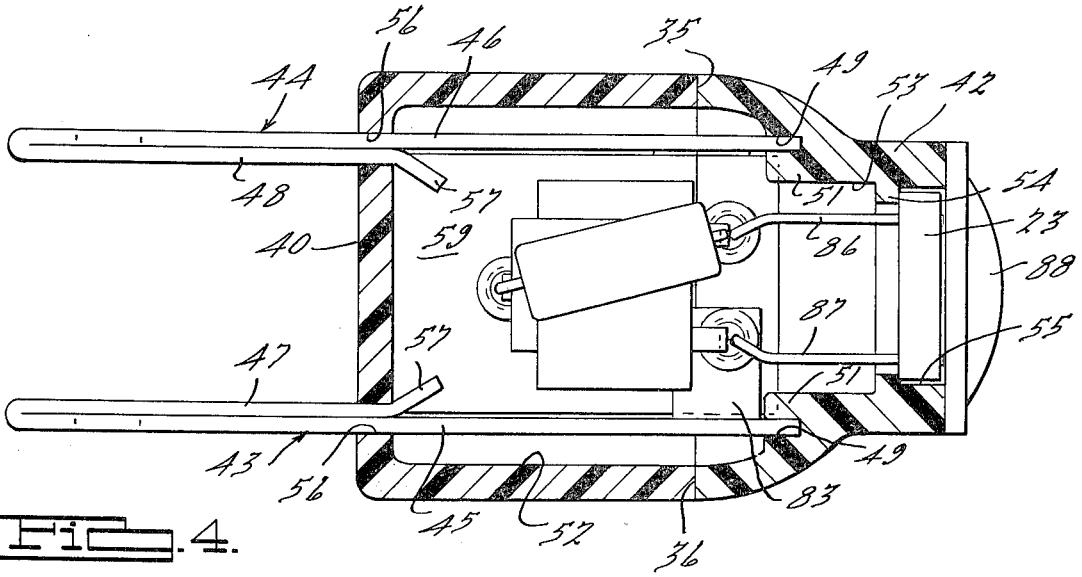
FIG. 4 is a bottom plan view in cross-section taken along the line 4—4 of FIG. 2.
Figure 3:
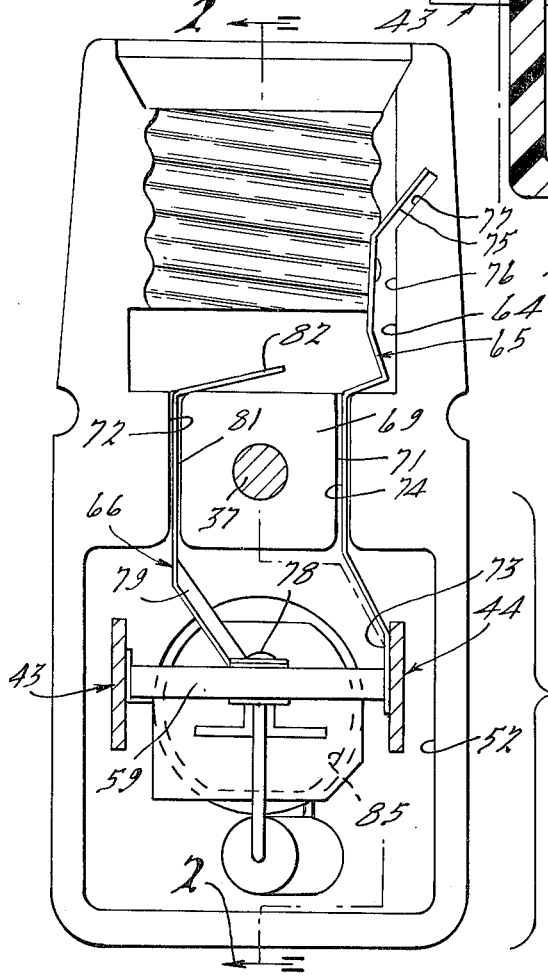
FIG. 3 is an elevational view of the unit with one housing half removed, and the prongs and fastener sectioned.

As shown in FIGS. 2, 3 and 4, housing 12 may be fabricated of two mating molded plastic parts generally indicated at 33 and 34 having abutting surfaces 35 and 36 respectively and held together by a fastener 37 in aligned apertures 38 and 39 of the housing halves. Circuit portion 13 of the housing has a flat end surface 40 facing outlet 41 and an extension 42 at the other end supporting light-sensitive device 23. A pair of contact prongs generally indicated at 43 and 44 are provided for insertion in the outlet. These prongs comprise bars of rectangular cross-section with main portions 45 and 46 and bent-back portions 47 and 48. The inner end of the main portion of each prong is received by a recess 49, the recesses being formed in a pair of shoulders 51 on the interior of the housing. The circuit portion of the housing has a relatively wide main compartment 52 and a narrower space 53 leading from this compartment to a shoulder 54 in extension 42, device 23 being disposed in a recess 55 and resting against shoulder 54. Shoulders 51 are disposed between compartment 52 and space 53, with prong portions 45 and 46 being spaced inwardly from the walls of compartment 52 as seen in FIG. 4.

The prongs extend through apertures 56 of wall 40, with portions 47 and 48 of the prongs being bent-back along the main portions and also passing through these apertures. The inner ends 57 of prong portions 47 and 48 are angled inwardly immediately inside wall 40, and are provided with slots 58 for the support of a circuit board 59.

The circuit board, which may be fabricated of a rigid dielectric material, is disposed between and slightly spaced from the main portions 45 and 46 of the prongs within compartment 52. One end of the circuit board abuts the inner surface of wall 40, and the corners of this end are disposed within slots 58 of the prongs. The two opposite corners of the circuit board are disposed in a pair of slots 61 formed in shoulders 51 of the housing. Thus, as seen best in FIGS. 2 and 3, all four corners of the circuit board will be firmly held in position so that the board has abundant space above and below for the mounting and connecting of other components of the assembly.

Lamp portion 14 of the housing extends upwardly from the circuit portion and may be slightly tapered for appearance purposes. An interior thread 62 is provided for the reception of base 63 of lamp 18 which projects about the housing. A wider compartment 64 is provided below threaded portion 62 for the lamp contacts. These comprise a leaf spring contact member generally indicated at 65 for connection between the threaded base 63 and prong 44, and a leaf spring contact generally indicated at 66 for connecting the central contact 67 of the lamp to SCR 19 and resistor 22.

Because of the configuration of housing 12, lamp 18 will be located a considerable distance from light sensitive device 23, the latter facing away from the lamp and being shielded from its rays by the housing. Thus, light-sensitive device 23 will be responsive primarily to the ambient room light. A shade indicated partially in dot-dash lines at 68 is preferably also provided on lamp 18 to further reduce the effect of the lamp on the light-sensitive device.

A wall 69 is formed in the housing between compartment 52 and base 37, fastener apertures 38 and 39 being formed in this wall. The wall is also provided with a pair of through slots 71 and 72 for contacts 65 and 66 respectively. The lower end 73 of contact 65 is disposed between portion 45 of prong 44 and circuit board 59, as seen in FIG. 3, thus holding the contact in electrical engagement with prong 44. The midportion 74 of this contact is disposed in slot 71, the contact on either side of this midportion being bent so as to retain the contact in this slot. The upper portion 75 of contact 65 is disposed in a recess 76 of lamp portion 14 and is so located as to be engageable by lamp base 63 when it is screwed in. The upper end of this contact portion is disposed within an angled recess 77 which holds it in place.

The lower end of contact 66 is secured by a rivet 78 to circuit board 59. Resistor 22 and SCR 19 are mounted on the underside of the circuit board and the SCR anode 26 and one end of resistor 22 are connected to this conductive fastener. Contact 66 has a portion 79 extending upwardly at an angle from rivet 78 toward a portion 81 of the contact which extends through slot 72. An upwardly angled portion 82 of contact 66 is engageable by button 67 of the light bulb in chamber 64.

Voltage to the circuit mounted on board 59 is provided by a spring contact 83 secured by a rivet 84 to the mounting board and making contact with portion 45 of prong 43. The electronic components are soldered into the contacts necessary to connect the circuit to the socket prongs and the light bulb. A portion of part 34 of the housing is provided with an oblong opening 85, and light-sensitive device 23 is locked into the housing by inserting it through this hole and twisting it 90° so that the device is supported by shoulder 54. Leads 86 and 87 extend from device 23 to circuit board 59. A lens 88 is provided, having a flange 89 engageable with outer surface 91 of the housing, and resilient shouldered legs 92 and 93 which may be inserted past device 23 so that they snap in behind shoulders 54 of the housing. Lens 88 will thus locate device 23 so that it cannot be moved in any direction or be rotated, and will protect device 23 against damage.

It should be observed that the construction and supporting means for the mounting board and the securing of various components by rivet fasteners to the board allows the internal components of the night light to be assembled as easily as possible, the arrangement also lending itself to assembly by high production methods.

In use of the device, prongs 43 and 44 will be inserted in outlet 42 with lamp 18 upright and sensing device 23 exposed to the ambient light in the room. The functioning of the circuit will be as described above with respect to FIG. 1, with the light output of lamp 18 being modulated in accordance with the ambient room light level. The configuration of the entire assembly, together with the presence of shade 68, will be such as to minimize the amount of light feedback possible from lamp 18 to device 23 thereby minimizing the light flickering under almost all conditions.

Figure 5:
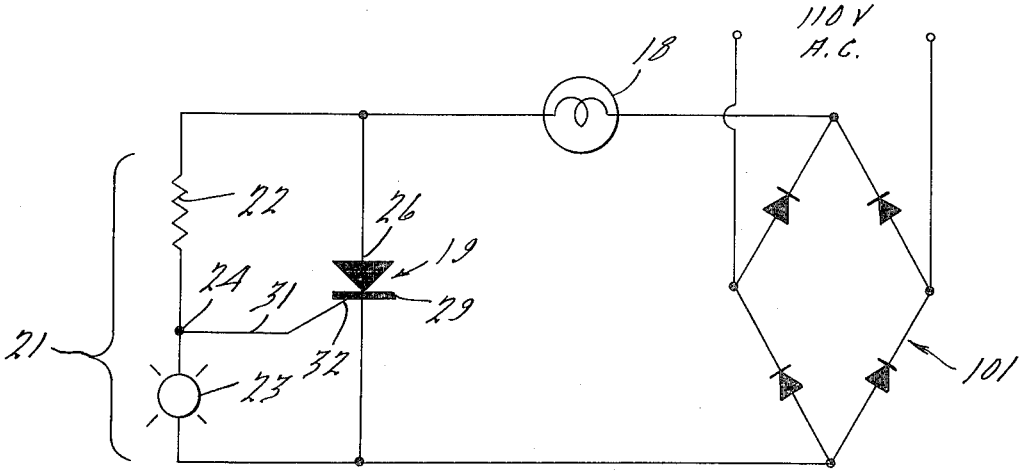
FIG. 5 is a diagram of a modified form of circuit for the night light in which the power source is connected to a full wave diode bridge circuit.

FIG. 5 shows a modified form of the circuit which is basically similar to that of FIG. 1 but adds a full wave bridge circuit, generally indicated at 101, between the 110 volt AC source and the series-connected lamp 18 and SCR 19. The output of full wave diode bridge circuit 101 has one end connected to lamp 18 and the other connected to SCR 19. The operation of the circuit shown in FIG. 5 will be basically the same as that described previously. However, since lamp 18 now has a pulsating full wave rectified DC voltage being delivered to it, a higher light level will be attained from lamp 18 while all the other aforementioned advantages of the invention are retained.

I claim:

1. A night light structure comprising a housing having a circuit portion and a lamp portion extending therefrom, said circuit portion having a first wall with a pair of outlet prongs extending therefrom and an interior compartment, said prongs extending along opposite sides of said compartment, shoulder means on the side of said compartment remote from said wall, a circuit board in said compartment, means supporting said circuit board comprising portions of said prongs supporting one end of said board, said shoulder means supporting the other end of said board, the side edges of said board being disposed between the portions of said prongs within said compartment, means on the end of said circuit portion of the housing remote from said wall supporting a light-sensitive resistor, and conductive means leading from said light-sensitive resistor to said circuit board.

2. A structure according to claim 1, said lamp portion of the housing having an upwardly open lamp socket, a wall between said lamp and circuit housing portions, and leaf spring contacts extending through said wall and connecting said lamp to said circuit board.

3. A structure according to claim 2, there being a pair of spring contacts, one contact having an end disposed between the circuit board and one of said prongs and in conductive engagement with said prong.

4. A structure according to claim 1, said board-supporting prong portions being bent back and extending through said wall.

5. A structure according to claim 1, said means for supporting the light-sensitive resistor comprising an opening in said housing facing away from said wall, a shoulder adjacent said engaging said shoulder, and a lens mounted on said housing outwardly of said light-sensitive resistor.

6. A structure according to claim 5, said lens having a pair of resilient fingers extending past opposite sides of said light-sensitive resistor with ends engageable behind said shoulder to hold the lens in place, said fingers limiting lateral movement of said light-sensitive resistor.

7. A structure according to claim 1, the inner ends of said prongs being received by recesses in said shoulder means facing the housing compartment, said board-supporting prong portions being bent-back portions of said prongs bent inwardly toward each other and being slotted to receive the corners of said circuit board.

8. A structure according to claim 1, said shoulder means having recesses supporting corners at said other end of the circuit board.

9. A structure according to claim 1, said housing being fabricated of two mating molded parts with the mating line extending through said circuit and lamp portions of the housing and parallel to said wall, and fastener means holding said housing parts together.

10. A structure for a night light comprising a housing having a circuit portion and a lamp portion thereabove, the circuit portion having a wall at one end, an interior compartment contiguous with said wall, shoulder means on the end of said compartment opposite said wall, and a recess leading from said shoulder means to the other end of said housing circuit portion, a pair of prongs having inner ends supported by recesses in said shoulder means, extending along the sides of said compartment, through said wall, and having bent-back portions passing through said wall to said compartment, the inner ends of said bent-back portions being bent inwardly and having slots, a rectangular circuit board disposed between said prongs and having two corners received by said slots, recesses in said shoulder means receiving the other two corners of said circuit board, a fixed resistor and a solid-state switch supported by said circuit board in said compartment, an upwardly open lamp base socket in said lamp portion of the housing with a space therebelow, a wall between said space and said compartment, a pair of leaf spring contacts extending through slots in said wall, the first contact having a lower end disposed between one edge of said circuit board and one of said prongs and an upper end disposed in said socket opening, the second contact having a lower end secured by a fastener to said circuit board and an upper end engageable with a bulb in said socket, a light-sensitive resistor disposed in the recess of said housing circuit portion and facing outwardly, a shoulder in said recess engageable by said light-sensitive resistor, a lens mounted on said housing and having means extending inwardly therefrom engaging portions of the housing to hold the lens in place and also serving to support the light-sensitive resistor against lateral movement, and conducting means extending from said light-sensitive resistor through said recess to said circuit board.

* * * * *